US005341747A

United States Patent [19]

Fetterman et al.

[11] Patent Number: 5,341,747

[45] Date of Patent: * Aug. 30, 1994

[54] RAILWAY GONDOLA CAR

[75] Inventors: D. Bruce Fetterman, Arlington; Stephen W. Smith, Dallas, both of Tex.

[73] Assignee: Trinity Industries, Inc., Dallas, Tex.

[ * ] Notice: The portion of the term of this patent subsequent to Jan. 12, 2010 has been disclaimed.

[21] Appl. No.: 1,838

[22] Filed: Jan. 8, 1993

Related U.S. Application Data

[63] Continuation-in-part of Ser. No. 795,495, Nov. 21, 1991, Pat. No. 5,178,074, and a continuation-in-part of Ser. No. 986,752, Dec. 8, 1992, abandoned, and a continuation-in-part of Ser. No. 2,354, Dec. 9, 1992, Pat. No. Des. 344,913.

[51] Int. Cl.[5] ..... B61D 7/00

[52] U.S. Cl. ..... 105/406.1; 105/404; 105/422; 105/355

[58] Field of Search ..... 105/244, 245, 246, 355, 105/406.1, 416, 422, 247, 249, 358, 360

[56] References Cited

U.S. PATENT DOCUMENTS

| | | | |
|---|---|---|---|
| 5,175 | 6/1847 | Winans . | |
| 45,834 | 1/1865 | Keeler . | |
| 190,542 | 5/1877 | Brooks . | |
| 719,868 | 2/1903 | Randel . | |
| 764,390 | 7/1904 | Stoller et al. . | |
| 934,578 | 9/1909 | Stoller . | |
| 1,054,087 | 2/1913 | Campbell . | |
| 1,069,763 | 8/1913 | Campbell . | |
| 1,412,660 | 4/1922 | Kuehner . | |
| 1,627,256 | 5/1927 | Smith . | |
| 1,749,756 | 5/1929 | Albrecht | 105/406.1 |
| 2,648,294 | 8/1953 | Sheehan et al. | 105/406.1 |
| 2,835,208 | 5/1958 | Faverty | 105/251 |
| 3,479,724 | 11/1969 | Kruizenga et al. | 105/358 |
| 3,713,400 | 1/1973 | Teoli | 105/406 |
| 3,964,399 | 6/1976 | Miller et al. | 105/406 |
| 4,044,690 | 8/1977 | Deeks | 105/406.1 |
| 4,212,252 | 7/1980 | Hart et al. | 105/406 |
| 4,254,714 | 3/1981 | Heap | 105/406 |
| 4,361,097 | 11/1982 | Jones et al. | 105/406 |
| 4,484,528 | 11/1984 | Anderson et al. | 105/358 |
| 4,637,320 | 1/1987 | Paton et al. | 105/406 |
| 5,058,509 | 10/1991 | Kurtz | 105/226 |

FOREIGN PATENT DOCUMENTS

| | | |
|---|---|---|
| 367150 | 1/1950 | South Africa . |
| 1671 | of 1896 | United Kingdom . |
| 22852 | of 1913 | United Kingdom . |
| 1064788 | 4/1967 | United Kingdom . |

OTHER PUBLICATIONS

Progressive Railroading article dated Aug., 1977, "APTA's Aboudara: A Practical Approach to Transit Today".

*Primary Examiner*—Mark T. Le
*Attorney, Agent, or Firm*—Baker & Botts

[57] ABSTRACT

A rotary dump railway gondola car that includes troughs which extend downwardly from the midpoint of the car toward the trucks. End members for the troughs extend at an enlarged angle relative to the car's center sill to increase the carrying capacity of the car. The end members have been further modified to include a bracket which attaches each end member to the center sill. A chamfer is located near the lower portion of each end member to allow drainage from the associated trough. Sections of the floor in the car adjacent to the troughs have been modified to increase load carrying capacity. The troughs may also include a longitudinal radius to further increase the load carrying capacity of the car.

31 Claims, 2 Drawing Sheets

RAILWAY GONDOLA CAR

This is a continuation-in-part application of U.S. patent application Ser. No. 07/795,495, filed Nov. 21, 1991 and entitled "Railway Gondola Car", now U.S. Pat. No. 5,178,074.

U.S. patent application Ser. No. 07/986,752, filed Dec. 8, 1992 and entitled "Improved Railway Gondola Car", now abandoned; and U.S. patent application Ser. Des. No. 29/002354 filed Dec. 9, 1992 and entitled "Railway Gondola Car" now U.S. Pat. Des. No. 344,913.

TECHNICAL FIELD OF THE INVENTION

This invention relates generally to a railway car of the gondola type that is commonly used for carrying bulk materials. More particularly, and not by way limitation, this invention relates to an improved gondola car which is loaded through an open top and unloaded by inverting the entire car.

BACKGROUND OF THE INVENTION

Currently, some gondola cars of the rotary dump type are constructed to include a depressed center section to lower the center of gravity of the car and to provide increased capacity for the car. One such car is described in U.S. Pat. No. 3,713,400 to Teoli.

A more recent patent on a rotary dump gondola car is U.S. Pat. No. 4,361,097 issued to Jones, et al. on Nov. 30, 1982. The gondola car of the '097 patent includes a depressed center portion that is constructed of two parallel extending concave troughs that are disposed between the trucks supporting the car.

The present invention provides an improved gondola car of the rotary dump type that includes multiple troughs that extend between the trucks supporting the railway car and are disposed along each side of a center sill that extends the full length of the car. The troughs of the car of the present invention, contrary to those illustrated in the '097 patent, are deeper adjacent to the trucks than at the latitudinal center line of the car. Each trough of the car of the present invention has a longitudinal center line or axis that extends at an angle relative to the longitudinal center line of the car. The ability to make the troughs deeper near the trucks provides a greater capacity car having a lower center of gravity or, on the other hand, provides a car having the same capacity with a lower overall height to reduce the drag effect from the wind as the car is being pulled along the tracks.

SUMMARY OF THE INVENTION

In accordance with the present invention, the disadvantages and problems associated with previous rotary dump gondola cars which include troughs below the center sill have been substantially reduced or eliminated. The present invention allows the load carrying capacity of a rotary dump gondola car to be substantially increased, while retaining the same overall dimensions of length, width and height as compared to previous gondola cars. The present invention also allows optimizing the gondola car design to produce a lower center of gravity and lower car height for reduced wind resistance while maintaining maximum allowed load carrying capability.

In one aspect, this invention provides an improved bottom structure for a rotary dump, railway gondola car wherein the bottom structure includes a pair of troughs that extend along the longitudinal axis of the car between the trucks and that extend at an angle from the highest point, relative to the railway tracks, adjacent to the middle of the car to the lowest point, relative to the railway tracks, adjacent to the trucks.

In another aspect, this invention provides an improved rotary dump, railway gondola car that includes a longitudinally extending center sill, trucks supporting each end of the center sill, a hollow gondola body supported by the center sill, sides and a bottom structure that includes pairs of troughs extending downwardly at an angle from near the center of the car toward the trucks.

A significant technical advantage of the present invention is that end members which are used to close the troughs are installed at an angle relative to the center sill of the gondola car to improve the load carrying capacity of the car. A bracket is placed between each end member and the center sill to provide additional support for the end members. A chamfer is placed near the lower portion of each end member to allow liquids to drain from the respective troughs which are closed by the end members.

Further technical advantages of the present invention include modifying floor sections above the center sill and adjacent to the troughs to increase the load carrying capacity. At one end of the gondola car, the first floor section is installed parallel with and immediately adjacent to the center sill. At the other end of the gondola car, the second floor section has a first subsection which is parallel to the center sill and a second subsection which is tapered at an angle relative to the center sill and the adjacent end of the car.

A further technical advantage of the present invention includes modifying the troughs of the gondola car to have a longitudinal radius or a series of straight segments which approximates the allowed vertical curvature for railroad tracks.

BRIEF DESCRIPTION OF THE DRAWINGS

The foregoing and additional objects and advantages of the invention will become more apparent as the following detailed description is read in conjunction with the accompanying drawings wherein like reference characters denote like parts in all views and wherein.

DETAILED DESCRIPTION OF THE PREFERRED EMBODIMENT

Figure 1:
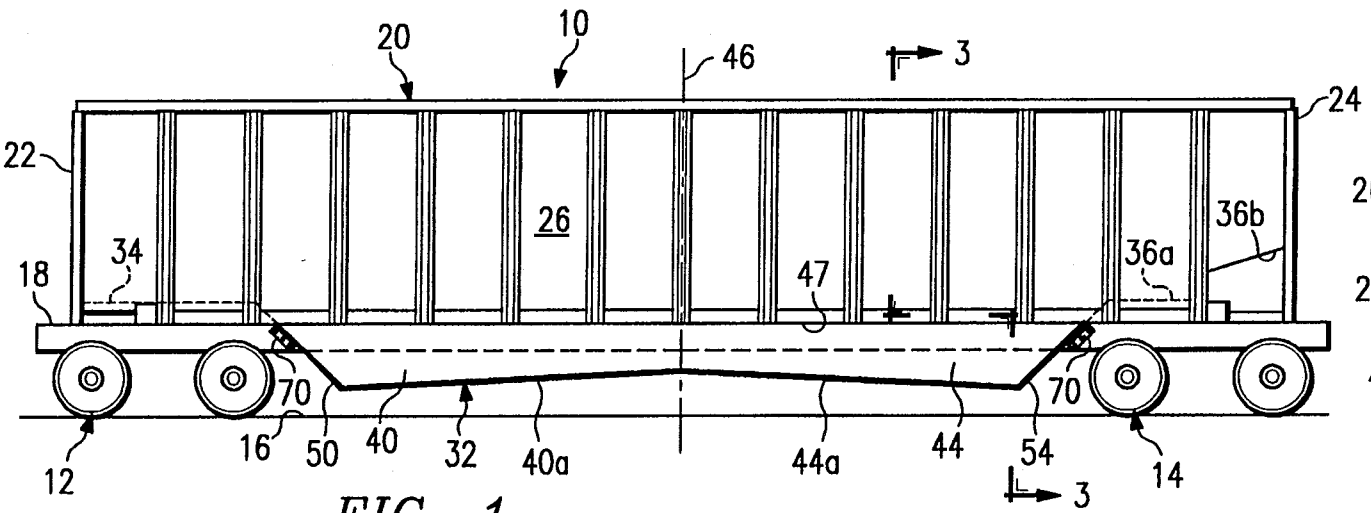
FIG. 1 is a schematic drawing in elevation of a side view of a rotary dump railway gondola car constructed in accordance with the present invention.

Referring to the drawings and to FIG. 1 in particular, shown therein and generally designated by the reference character 10 is a rotary dump railway gondola car. Gondola car 10 includes front and rear trucks 12 and 14 that support gondola car 10 for movement along tracks 16. Mounted on trucks 12 and 14 is a center sill 18 that extends longitudinally through gondola car 10. The center sill 18 is pivotally connected to the trucks 12 and 14 by means (not shown) that are well understood in the railway car art.

Gondola car 10 also includes a gondola body 20 that includes front and rear ends or walls 22 and 24 and left and right side ends or walls 26 and 28. As may be seen better in FIGS. 2 and 3, body 20 also includes an open top 30. Gondola body 20 also includes bottom assembly 32 comprising a front or first floor section 34 and a rear or second floor section 36. Each floor section 34 and 36 extend from front wall 22 and rear wall 24 respectively toward the mid portion of gondola car 10 between trucks 12 and 14.

Figure 2:
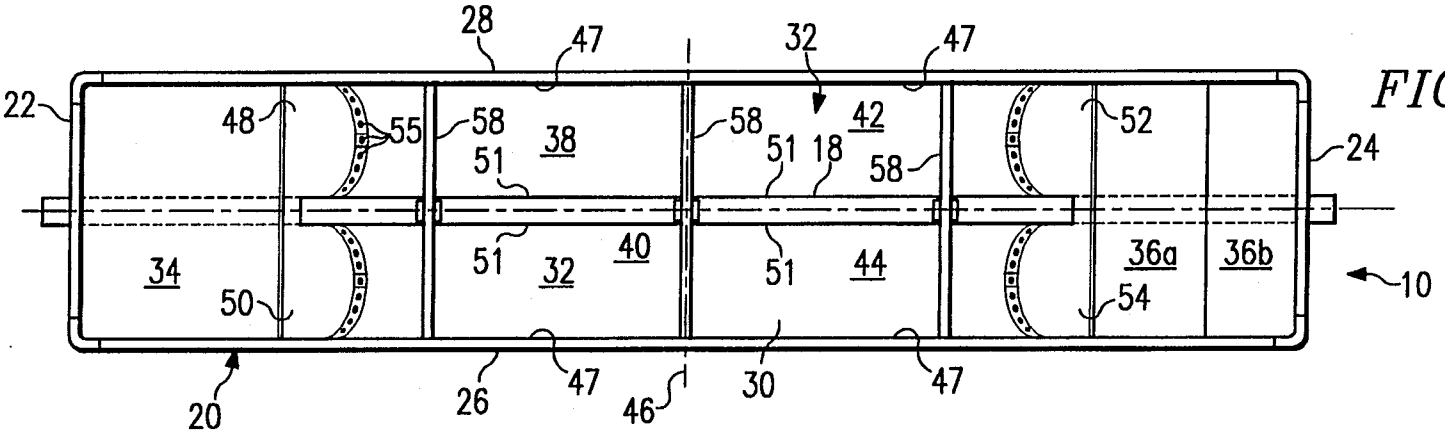
FIG. 2 is a top plan view of the gondola car of FIG. 1.
Figure 3:
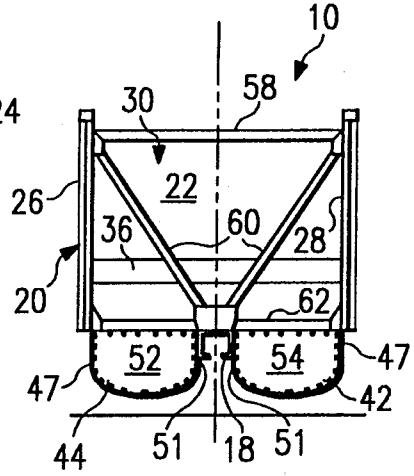
FIG. 3 is a cross sectional view with portions broken away of the gondola car of FIG. 1 taken generally along the line 3—3 of FIG. 1.

Bottom assembly 32 also includes four generally concave troughs 38, 40, 42 and 44 (see also FIG. 2). Each trough 38, 40, 42 and 44 has a higher or first end located adjacent to latitudinal center line 46 of gondola car 10. The first ends of troughs 38, 40, 42 and 44 are connected at center line 46. Lower or second ends of troughs 38, 40, 42 and 44 are located adjacent to trucks 12 and 14. Troughs 38 and 42 cooperate with each other to provide a right bottom portion for bottom assembly 32. Troughs 40 and 44 cooperate with each other to provide a left bottom portion for bottom assembly 32.

The second end of each trough 38, 40, 42 and 44 is provided with an end member 48, 50, 52 or 54 respectively, which are themselves disposed at an angle relative to vertical and the longitudinal center line of center sill 18. End members 48, 50, 52 and 54 close their respective troughs to hold material carried by gondola car 10. The second ends of the troughs are located closer to track 16 than are the first ends of the troughs. Also, the longitudinal center line of each trough 38, 40, 42 and 44 forms an angle relative to the longitudinal center line of center sill 18. The increased angle between the troughs and their respective end members helps to eliminate build-up of bulk materials at the ends of the troughs, thus improving the rotary dumping operations. It will be noted that each of the troughs extends downwardly at an angle from the higher, first ends thereof toward the lower, second ends.

Figure 4:
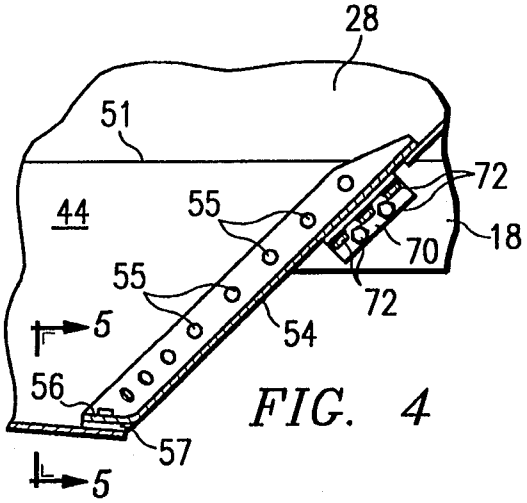
FIG. 4 is an enlarged drawing partially in elevation and partially in section showing an end member used to close a trough in the railway gondola car of FIG. 1.

FIG. 4 is an enlarged drawing showing the relationship between trough 44, end member 54 and center sill 18. Troughs 38, 40 and 42 have a similar relationship with respect to their respective end member and center sill 18. The load carrying capacity of gondola car 10 may be increased by increasing the angle at which end members 48, 50, 52 and 54 extend relative to the longitudinal axis of center sill 18. As best shown in FIG. 4, the preferred angle between end member 54 and the longitudinal center line of center sill 18 is approximately forty-five degrees. By extending end members 48, 50, 52 and 54, at an angle between forty degrees and fifty degrees relative to center sill 18, the load carrying capacity of gondola car 10 is optimized.

Outside edges 47 of each of the troughs are connected, such as by fasteners, to the lower edge of one of the sides 26 or 28. Generally, a structural member (not shown), such as a side sill, may be located between edges 47 and side walls 26 and 28. Similarly, inside edges 51 of each trough are connected to center sill 18. The angular dispositions of the troughs, both their longitudinal center line and the line connecting the first end with the second end, are selected to fit relatively close to the allowed vertical curvature of track 16.

To add structural stability to gondola body 20, a plurality of spaced cross members 58 that extend between the upper edges of sides 26 and 28 and a plurality of spaced diagonal braces 60 that extend from sides 26 and 28 to center sill 18 are provided. Stability for the lower part of body 20 is provided by cross members 62.

Figure 5:
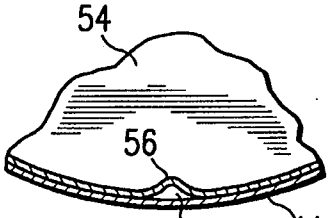
FIG. 5 is an enlarged drawing partially in elevation and partially in section showing the lower portion of the end member of FIG. 4, and its engagement with the second end of the trough to provide a drainage flow path from the trough.

As best shown in FIGS. 4 and 5 for end member 54, each end member 48, 50, 52 and 54 includes chamfer 56 formed in the lower portion of each end member 48, 50, 52 and 54 adjacent to the respective second end of troughs 38, 40, 42 and 44. Preferably, chamfer 56 is located at the lowest point in each trough. Chamfer 56 provides an opening or drainage flow path 57 to allow liquids to drain from the associated trough. It is desirable that drainage flow paths 57 be located at the lowest point to prevent the deleterious effects of water or chemicals that may enter gondola car 10 and stand therein in the absence of chamfers 56 and drainage flow paths 57.

Figure 6:
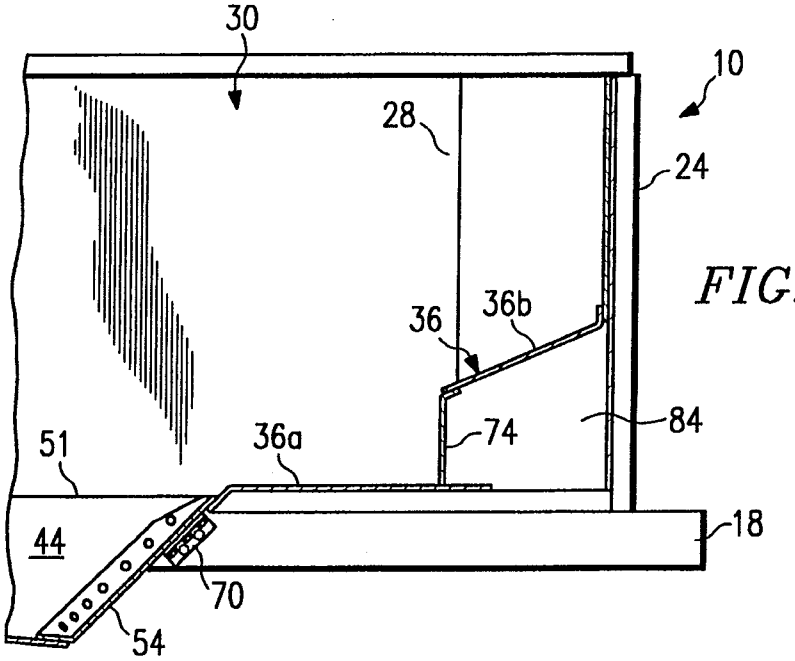
FIG. 6 is a schematic drawing partially in elevation and partially in section with portions broken away showing the floor section for the rear end or B end of the railway gondola car of FIG. 1.

End members 48, 50, 52 and 54 are sized to fit within the second end of their respective troughs 38, 40, 42 and 44. A single row of fasteners 55 is used to attach each end member within its respective second end of the troughs. As shown in FIGS. 1, 4 and 6, each end member 48, 50, 52 and 54 is also provided with a supporting bracket 70 which is secured by bolts 72 between the respective end member and the portion of center sill 18 adjacent to each end member. Fasteners 55 cooperate with supporting brackets 70 to allow positioning end members 48, 50, 52 and 54 at the optimum angle relative to center sill 18 for both load carrying capacity and structural integrity.

The load carrying capacity of gondola car 10 has been further increased by the use of floor sections 34 and 36. First floor section 34 is disposed above center sill 18 adjacent to front end 22 of gondola car 10. Front end 22 is often referred to as the A end of a railway car. Second floor section 36 is disposed above center sill 18 adjacent to the rear end 24 of gondola car 10. Rear end 24 is often referred to as the B end of a railway car. First floor section 34 is positioned essentially parallel with and adjacent to center sill 18. First floor section 34 preferably extends between front wall 22 and the second end of troughs 38 and 40. First floor section 34 may be inclined slightly relative to center sill 18 to aid in the drainage of liquids into troughs 38 and 40. As previously noted, this configuration for first floor section 34 substantially increases the load carrying capacity of gondola car 10.

Second floor section 36 is located adjacent to the rear end or B end of gondola car 10. Traditionally, breaking equipment, hydraulic systems and other similar auxiliary systems are located adjacent to the B end of a railway car. Therefore, a portion of second floor section 36 extends at an angle relative to center sill 18 and intersects rear wall 24 above center sill 18 to provide void space 84 for such equipment.

As shown in FIG. 6, second floor section 36 has two subsections, 36*a* and 36*b*. Subsection 36*a* is positioned essentially parallel with and adjacent to center sill 18 in the same manner as first floor section 34 at the A end of gondola car 10. Subsection 36*a* extends from the second end of troughs 42 and 44 to bolster 74. If desired, subsection 36*a* may be inclined slightly relative to center sill 18 to aid in the drainage of liquids into troughs 42 and 44.

Bolster 74 is a supporting member that extends laterally across center sill 18 and is connected with side sills (not shown). Subsection 36*b* extends at an angle from the top of bolster 74 to rear end or wall 24. If desired, second floor section 36 could be formed as a single continuous member extending from rear end 24 to a point adjacent the second end of troughs 42 and 44. However, by placing subsection 36*a* essentially parallel and adjacent to center sill 18, the carrying capacity of gondola car 10 is further increased.

If desired, both ends of gondolar car 10 may be provided with floor sections which are identical. Therefore, a railway gondola car incorporating the present invention could be provided having first and second floor sections which are similar in design to first floor section 34. In the same respect, a railway gondola car incorporating the present invention could be provided having first and second floor sections which are similar in design to second floor section 36. The floor section designs at the ends of the gondola car above center sill 18 may be selected to optimize the load carrying capacity of the gondola car.

With prior art cars, the troughs are often located parallel with the center sill so that the distance from the bottom of the gondola car to the railway track is a constant distance. By providing the angularly disposed troughs 38, 40, 42 and 44 which generally fit the maximum allowed vertical curve for railway tracks, the portions of the troughs adjacent to the trucks can be located closer to track 16. The result is that the center of gravity of gondola car 10 is lowered, providing a more stable car when loaded.

Figure 7:
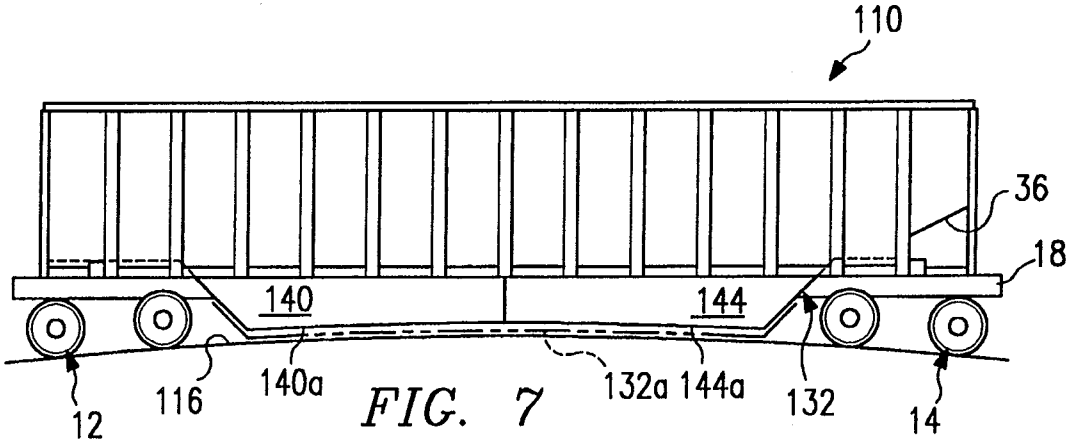
FIG. 7 is a schematic drawing showing a side elevation of a rotary dump railway gondola car constructed in accordance with another embodiment of the present invention.

Car 110 and track 116 shown in FIG. 7 are drawn to illustrate the minimum vertical curve clearance required by the Association of American Railroads for this type of gondola car. By regulation, railway tracks are limited to a maximum vertical curve radius of 300 feet. Therefore, gondola type car must accommodate a minimum clearance radius of 300 feet.

As shown in FIG. 1, the lowest portion of troughs 38, 40, 42 and 44 extends in a straight line from their respective second end to their first end. This straight line designated as 40*a* and 44*a* in FIG. 1 represents the bottom of the concave curvature of troughs 40 and 44. As previously noted, the bottom of troughs 38, 40, 42 and 44 extend at an angle relative to the longitudinal center line of center sill 18.

Gondola car 110 shown in FIG. 7 includes an alternative embodiment of the present invention. The troughs which comprise the bottom portions of gondola car 110 are similar to troughs 38, 40, 42 and 44 shown with respect to gondola car 10. Bottom assembly 132 for gondola car 110 includes four troughs which are arranged in the same manner as troughs 38, 40, 42 and 44 of gondola car 10. Troughs 140 and 144 cooperate to define the left bottom portion of bottom assembly 132. The principal difference between gondola car 10 and gondola car 110 is that the bottom of troughs 140 and 144 are formed with a longitudinal radius. Thus, the line extending from the second end of trough 140 through the first end of troughs 140 and 144 to the second end of trough 144 defines a radius of curvature rather than intersecting straight lines 40*a* and 44*a* shown in FIG. 1.

As best shown in FIG. 7, the lower portions of troughs 140 and 144 define lines 140*a* and 144*a* which cooperate to provide a radius which matches the allowed maximum vertical radius for railroad tracks. By manufacturing troughs of gondola car 110 to define a longitudinal radius, the carrying capacity of gondola car 110 is further increased as compared to gondola car 10. Since lines 140*a* and 144*a* define a radius of curvature. This curvature may extend closer to the maximum curvature allowed for tracks 116 as compared to straight lines 40*a* and 44*a* of gondola car 10 shown in FIG. 1.

Solid lines 140*a* and 144*a* illustrate the position that troughs 140 and 144 occupy when car 110 is unloaded. Due to spring deflection in a loaded car, the bottom of the troughs 140 and 144 is indicated by a dash line 132*a* which represents the loaded position of bottom assembly 132 for gondola car 110. It will be noted that line 132*a* indicating the loaded position of the troughs does not touch the maximum allowed vertical curve as shown for track 116.

As will be appreciated from the foregoing detailed description, a gondola car constructed in accordance with the present invention provides for the lowering of the center of gravity and for greater load capacity as compared to prior gondola cars. In the alternative, the car may have a lower center of gravity while maintaining the same capacity with a lower overall height which provides for less wind resistance and more efficient operation. Various elements of the present invention may be combined to produce a gondola car with optimum characteristics of load capacity, wind resistance, manufacturing costs, etc.

The foregoing detailed description has been presented by way of example only. Many changes and modifications can be made thereto without departing from the scope and spirit of the invention.

What is claimed is:

1. A railway gondola car including trucks for movably supporting the car on railway tracks, comprising:

a center sill extending longitudinally between said trucks;

a gondola body including front and rear walls, side walls and a bottom assembly;

said bottom assembly including a plurality of generally concave troughs, said troughs being located on each side of said center sill and extending between said trucks, each trough extending at a downward angle from a first end towards a second end;

said first ends being located near the mid point of said center sill between said trucks and said second ends being located proximate said trucks;

end members connected to and closing said second end of each trough; and said end members disposed at an angle relative to said center sill of approximately forty degrees to fifty degrees.

2. The gondola car as defined in claim 1 further comprising a plurality of supporting brackets for attaching each end member with said center sill.

3. The gondola car as defined in claim 1 further comprising a single row of fasteners for attaching each end member to its respective second end of each trough.

4. The gondola car as defined in claim 1 wherein said end members further comprise a chamfer formed in the lower portion of each end member adjacent said respective trough whereby any liquids contained within said trough may drain therefrom.

5. The gondola car as defined in claim 1 further comprising:

a first floor section disposed above said center sill at one end of said car;

a second floor section disposed above said center sill at the other end of said car;

said first floor section positioned essentially parallel with and adjacent to said center sill;

said second floor section extending at an angle relative to said center sill; and said first and second floor sections extending from said second ends of said troughs to said respective front wall and rear wall.

6. The gondola car as defined in claim 5 wherein said second floor section further comprises:

a first subsection adjacent to said second end of said troughs disposed essentially parallel with and above said center sill; and a second subsection adjacent to said first subsection disposed at an angle relative to and above said center sill.

7. The gondola car as defined in claim 6 further comprising said second subsection partially defining a void space for auxiliary equipment carried by said car.

8. The gondola car as defined in claim 1 further comprising said troughs defining a longitudinal radius with sufficient clearance to accommodate a vertical curve having a 300 foot radius without said troughs interfering with any portion of said curve.

9. The gondola car as defined in claim 1 wherein said troughs further comprise the longitudinal center line of each trough extending at an angle relative to the longitudinal center line of said center sill.

10. The gondola car as defined in claim 1 wherein said plurality of troughs further comprise two troughs disposed on one side of said center sill and two troughs disposed on the other side of said center sill.

11. A railway gondola car including trucks for movably supporting the front and rear of the car on railway tracks comprising:

a center sill extending longitudinal between said trucks;

a gondola body including front and rear walls, side walls and a bottom assembly;

said bottom assembly projecting downwardly on each side of said center sill forming left and right bottom portions;

each bottom portion having an outer edge connected to one of said sidewalls and having an inner edge connected to said center sill;

each bottom portion extending downwardly from a midpoint of said center sill relative to said trucks to a low point adjacent to said trucks; and said bottom portions having a longitudinal radius for accommodating a vertical curve having a 300 foot radius without said bottom portions interfering with any portion of said vertical curve.

12. The railway gondola car as defined in claim 11 wherein said bottom portions further comprised:

a plurality of troughs located on each side of said center sill and extending between said trucks;

each trough extending at downwardly from a first end towards a second end;

said first ends being located near the midpoint of said center sill between said trucks and said second ends being located proximate said trucks; and end members connected to and closing said second end of each trough.

13. The railway gondola car as defined in claim 12 further comprising said end members disposed at an angle relative to said center sill of approximately forty degrees to fifty degrees.

14. The railway gondola car as defined in claim 12 further comprising a plurality of supporting brackets for attaching each end member with said center sill.

15. The railway gondola car as defined in claim 12 further comprising a single row of fasteners to attach each end member to its respective second end of said troughs.

16. The railway gondola car as defined in claim 12 wherein said end members further comprise a chamfer formed in the lower portion of each end member adjacent to said trough.

17. The railway gondola car as defined in claim 11 further comprising:

a first floor section disposed above said center sill at one end of said car and extending towards said front wall;

a second floor section disposed above said center sill at the other end of said car and extending towards said rear wall;

said first floor section positioned essentially parallel with and adjacent to said center sill; and said second floor section extending at an angle relative to said center sill.

18. The railway gondola car as defined in claim 17 further comprising said second floor section partially defining a void space for auxiliary equipment carried by said car.

19. The railway gondola car as defined in claim 11 wherein said troughs further comprise the longitudinal center line of each trough extending at an angle relative to the longitudinal center line of said center sill.

20. The railway gondola car as defined in claim 11 wherein said bottom portions further comprise two troughs disposed on one side of said center sill and two troughs disposed on the other side of said center sill.

21. A bottom assembly for a railway gondola car having a longitudinal center sill that extends between trucks which support the car on railway tracks, comprising:

a plurality of generally concave bottom members extending from a first end to a relatively deeper second end;

said first ends being arranged near the midpoint of said center sill between said trucks;

said second end being located proximate to said trucks;

a plurality of end members connected to and closing said second end of said bottom members; and each end member having a chamfer formed in its lower portion adjacent to its respective second end of said bottom member.

22. The bottom assembly as defined in claim 21 wherein said end members are disposed at an angle relative to said center sill of approximately forty degrees to fifty degrees.

23. The bottom assembly as defined in claim 21 further comprising a plurality of supporting brackets for attaching each end member with said center sill.

24. The bottom assembly as defined in claim 21 further comprising a single row of fasteners to attach each end member to its respective second end of said bottom members.

25. The bottom assembly as defined in claim 21 wherein said bottom members further comprise the longitudinal center line of said bottom members extending at an angle relative to the center line of said center sill.

26. The bottom assembly as defined in claim 21 further comprising:

a first floor section disposed above said center sill at one end of said car and extending towards said front wall;

a second floor section disposed above said center sill at the other end of said car and extending towards said rear wall;

said first floor section extending essentially parallel with and adjacent to said center sill;

said second floor section extending at an acute angle relative to said center sill; and said first and said second floor sections extending from said second ends of said bottom members to said respective front wall and rear wall.

27. The bottom assembly as defined in claim 21 wherein said bottom members further comprise a longitudinal radius with sufficient clearance to accommodate a vertical curve having a 300 foot radius without said bottom members interfering with any portion of said curve.

28. A railway gondola car including trucks for movably supporting the car on railway tracks, comprising:

a center sill extending longitudinally between said trucks;

a gondola body including front and rear walls, side walls and a bottom assembly;

said bottom assembly including a plurality of generally concave troughs, said troughs being located on each side of said center sill and extending between said trucks, each trough extending at a downward angle from a first end towards a second end;

said first ends being located near the mid point of said center sill between said trucks and said second ends being located proximate said trucks;

end members connected to and closing said second end of each trough;

a first floor section disposed above said center sill at one end of said car;

said first floor section positioned essentially parallel with and adjacent to said center sill;

a second floor section disposed above said center sill at the other end of said car; and said second floor section positioned essentially parallel with and adjacent to said center sill.

29. A railway gondola car including trucks for movably supporting the car on railway tracks, comprising:

a center sill extending longitudinally between said trucks;

a gondola body including front and rear walls, side walls and a bottom assembly;

said bottom assembly including a plurality of generally concave troughs, said troughs being located on each side of said center sill and extending between said trucks, each trough extending at a downward angle from a first end towards a second end;

said first ends being located near the mid point of said center sill between said trucks and said second ends being located proximate said trucks;

end members connected to and closing said second end of each trough;

a floor section disposed above said center sill at one end of said car extending from said second ends of said troughs;

said floor section having a first subsection adjacent to said second end of said troughs and disposed essentially parallel with and above said center sill; and said floor section having a second subsection adjacent to said first subsection disposed at an angle relative to and above said center sill.

30. The gondola car as defined in claim 29 further comprising:

a first floor section disposed above said center sill at one end of said car;

a second floor section disposed above said center sill at the other end of said car; and each floor section having said first subsection and said second subsection.

31. The gondola car as defined in claim 29 further comprising:

another floor section disposed above said center sill at the other end of said car;

said other floor section positioned essentially parallel with and adjacent to said center sill; and said other floor section extending from said second ends of said troughs to the other end of said car.

* * * * *